US009290899B2

(12) United States Patent
Fonseca

(10) Patent No.: US 9,290,899 B2
(45) Date of Patent: Mar. 22, 2016

(54) SNOW REMOVAL VEHICLE

(71) Applicant: Italo Fonseca, Abingdon, MD (US)

(72) Inventor: Italo Fonseca, Abingdon, MD (US)

( * ) Notice: Subject to any disclaimer, the term of this patent is extended or adjusted under 35 U.S.C. 154(b) by 93 days.

(21) Appl. No.: 14/252,470

(22) Filed: Apr. 14, 2014

(65) Prior Publication Data

US 2014/0305010 A1 Oct. 16, 2014

Related U.S. Application Data

(60) Provisional application No. 61/811,586, filed on Apr. 12, 2013.

(51) Int. Cl.
*E01H 5/10* (2006.01)
*E01H 5/09* (2006.01)

(52) U.S. Cl.
CPC ..... *E01H 5/098* (2013.01); *E01H 5/104* (2013.01)

(58) Field of Classification Search
CPC ..... E01H 5/104; E01H 5/12; E01H 5/108; E01H 5/102; E01H 5/10; E01H 5/106
See application file for complete search history.

(56) References Cited

U.S. PATENT DOCUMENTS 557,976 A * 4/1896 Craig ..... E01H 5/104 126/343.5 R
888,979 A * 5/1908 Emerson ..... E01H 5/104 122/4 R
9,909,445 * 8/1911 Friedman ..... E01H 5/104 126/343.5 R
1,242,433 A * 10/1917 Friedman ..... E01H 5/104 126/343.5 R
1,497,432 A * 6/1924 Dolan ..... E01H 5/104 37/228
2,104,363 A * 1/1938 Devlin ..... E01H 5/104 126/343.5 R
2,178,400 A * 10/1939 Marino ..... E01H 5/104 126/343.5 R
2,601,116 A * 6/1952 Gornick ..... E01H 5/104 126/343.5 R
2,877,762 A * 3/1959 Flynn ..... E01H 5/104 126/343.5 R
2,893,377 A * 7/1959 Janousek ..... 126/25 A
3,066,428 A * 12/1962 Raiti ..... E01H 5/104 126/343.5 R
3,304,632 A * 2/1967 Kotlar ..... E01H 5/104 126/343.5 R
3,320,688 A * 5/1967 Haban ..... B66F 9/18 37/242
3,404,470 A * 10/1968 Raiti ..... B65F 3/18 126/343.5 R
3,766,586 A * 10/1973 Krickovich ..... E01H 5/104 15/340.3
3,866,340 A * 2/1975 Krickovich ..... E01H 5/104 126/343.5 R
4,164,820 A * 8/1979 Krickovich ..... E01H 1/0845 15/340.3
4,353,176 A * 10/1982 Hess ..... E01H 5/104 126/343.5 R
5,079,865 A * 1/1992 Hutson ..... E01H 5/104 126/271.1
5,365,681 A * 11/1994 Miranda ..... E01H 5/104 37/199
5,953,837 A * 9/1999 Clifford ..... E01H 5/104 126/343.5 R
2004/0074114 A1* 4/2004 Rogers ..... E01H 5/106 37/228
2006/0272182 A1* 12/2006 Gertner ..... E01H 5/104 37/227
2010/0313451 A1* 12/2010 Trubiano ..... E01H 5/104 37/228
2014/0305010 A1* 10/2014 Fonseca ..... E01H 5/104 37/228

* cited by examiner

*Primary Examiner* — Jamie L McGowan

(57) ABSTRACT

A vehicle for collecting, melting, and transporting in order to facilitate snow removal operations during winter months. The vehicle is able to remove and dispose of snow from a plurality of environments. The vehicle accomplishes this through the user of a snow collection means mounted to the front section of an existing vehicle. The snow collection means channels removed snow through a snow conveyance means which transports the collected snow to a water tank positioned within an insulated enclosure. A high pressure nozzle sprays the collected snow while in the snow conveyance means to melt it before it reaches the water tank. The water tank contains the collected snow as water, but additional serves as reservoir for the high pressure nozzle.

14 Claims, 7 Drawing Sheets

SNOW REMOVAL VEHICLE

The current application claims a priority to the U.S. Provisional Patent application Ser. No. 61/811,586 filed on Apr. 12, 2013. The current application is filed on Apr. 14, 2014 while Apr. 12, 2014 was on a weekend.

FIELD OF THE INVENTION

The present invention relates generally to vehicles that removes, melts and disposes snow from the environment, and a method to remove, melt and dispose snow.

BACKGROUND OF THE INVENTION

The present invention discloses a snow removal vehicle that can comprise means to collect snow, means to convey the snow to a water tank, and water heater which creates hot water to be used to melt the snow. A certain amount of water from the melted snow can be pumped can be filtered and pumped back to the water heater to be used to melt snow. Excessive water from the melted snow can be stored in the water tank or pumped to an additional water storage device. Excessive water can also be released back into the environment when ambient temperature is above 35 F or dumped into the drainage system from either the water tank or the additional water storage device.

In one aspect, a snow removal vehicle can comprise a collecting means to collect snow, a conveying means to transfer the collected snow, a water tank, at least one water heater, at least one high pressure pump, at least one high pressure nozzle, and a water pump placed inside the water tank, wherein the collecting means will collect snow from the environment, wherein the conveying means will transfer the snow from the collecting means to the water tank, wherein the water pump will pump the water stored in the water tank to the at least one water heater, wherein the at least one water heater will heat the water to a predetermined temperature, wherein the at least one high pressure pump will pump the hot water from the at least one water heater to the at least one high pressure nozzle, wherein the at least one high pressure nozzle will spray the hot water into the conveying means, and wherein the hot water from the at least one high pressure nozzle will melt the collected snow into water.

In another aspect, a snow removal vehicle can comprise a collecting means to collect snow, a conveying means to transfer the collected snow, a water tank, at least one water heater to melt the snow, at least one high pressure pump, at least one high pressure nozzle, at least one storage tank, a first water pump placed inside the water tank, and a second water pump placed inside the water tank; wherein the collecting means will collect snow from the environment, wherein the conveying means will transfer the snow from the collecting means to the water tank, wherein the first water pump will pump the water stored in the water tank to the at least one water heater, wherein the at least one water heater will heat the water to a predetermined temperature, wherein the at least one high pressure pump will pump the hot water from the at least one water heater to the at least one high pressure nozzle, wherein the at least one high pressure nozzle will spray the hot water into the conveying means, and wherein the second water pump will pump excessive water from the water tank to the at least one storage tank.

In a further aspect, the invention discloses a method to remove snow that can comprise collecting snow from the environment through a collecting means, melting the snow using hot water from a water heater, conveying the melted snow into a water tank, and pumping the melted snow into a water heater to be heated into hot water.

In addition to the aspects and advantages or described in this summary, further aspects and advantages will become apparent by reference to the drawings and by reading the detailed description that follows.

BRIEF DESCRIPTIONS OF THE DRAWINGS

DETAIL DESCRIPTIONS OF THE INVENTION

Figure 1:
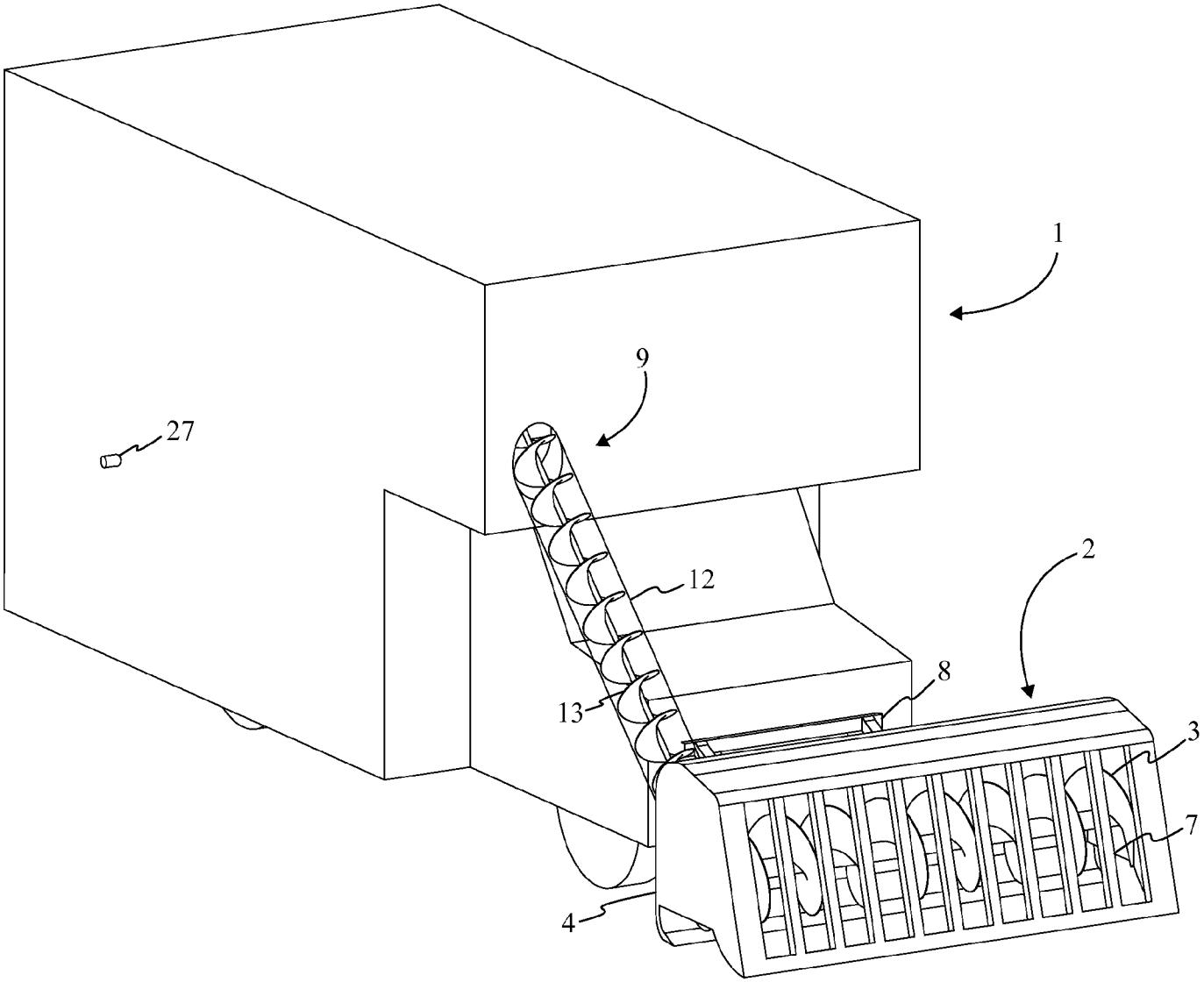
FIG. 1 is a frontal perspective view displaying the snow removal vehicle configured as per the current embodiment of the present invention.

All illustrations of the drawings are for the purpose of describing selected versions of the present invention and are not intended to limit the scope of the present invention.

In the following detailed description, reference is made to the accompanying drawings that form a part hereof, and in which is shown by way of illustration specific implementations that may be practiced. These implementations are described in sufficient detail to enable those skilled in the art to practice the implementations, and it is to be understood that other implementations may be utilized and that logical, mechanical, electrical and other changes may be made without departing from the scope of the implementation. The following detailed description is, therefore, not to be taken in a limiting sense.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Figure 2:
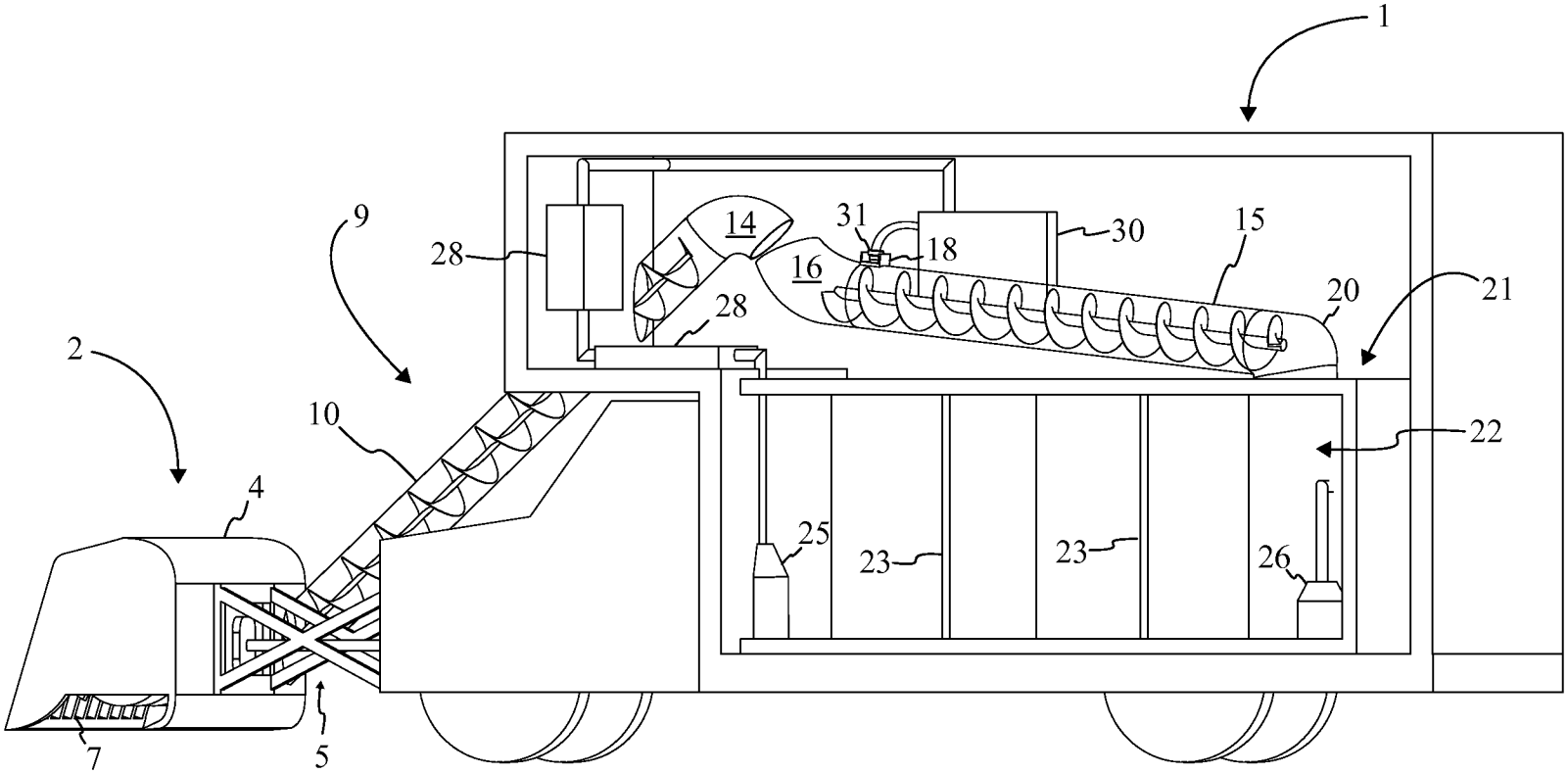
FIG. 2 is a sectional viewing displaying the interior arrangement of the insulated enclosure and the water tank configured as per the current embodiment of the present invention.

Referencing FIG. 1 and FIG. 2, the present invention is a snow removal vehicle that collects, melts, and transports snow facilitating the removal and the disposal of snow from a plurality of environments. The snow removal vehicle utilizes an existing vehicle platform as a means of securing and powering the various elements of the present invention. In the current embodiment of the present invention, the snow removal vehicle comprises an insulated enclosure 1, a snow collection means 2, a snow conveyance means 9, a water tank 21, a water heater system 28, a high pressure pump 30, and a high pressure nozzle 31. The insulated enclosure 1 is a structure mounted to the existing vehicle platform that contains the water tank 21 and the water heater 29. The snow collection means 2 is a mechanical system that collects snow from the environment. The snow conveyance means 9 is a mechanical system that transports the collected snow to the water tank 21. The water tank 21 is a container that receives the collected snow when melted and provides a water supply for the water heater system 28. The water heater system 28 heats water from the water tank 21 for the high pressure pump 30. The high pressure pump 30 forces the heated water through the high pressure nozzle 31. The high pressure nozzle 31 directs a stream of heated and pressurized water into the snow conveyance means 9 in order to melt the collected snow before reaching the water tank 21.

Referencing FIG. 1 and FIG. 2, the insulated enclosure 1 is a structure that houses various component elements of the present invention. The insulated enclosure 1 provides a barrier that reduces heat loss between the various components housed within it and the environment. The insulated enclosure 1 is secured to the existing vehicle platform. In the current embodiment of the present invention, the insulated enclosure 1 contains the water heater system 28 and the water tank 21. The insulated enclosure 1 partially houses and is partially traversed by the snow conveyance means 9. The partial positioning of the snow conveyance means 9 within the insulated enclosure 1 facilitates the engagement of the high pressure nozzle 31 to the high pressure pump 30 by allowing the high pressure nozzle 31 to engage the snow conveyance means 9 within the insulated enclosure 1. Furthermore, the positioning of the high pressure nozzle 31 within the enclosed portion of the snow conveyance means 9 reduces heat loss to the environment helping to maintain the temperature in the water tank 21 above freezing.

In an embodiment of the invention, the insulated enclosure 1 can be accomplished by the enclosed storage space of a box truck. In the aforementioned embodiment, the enclosed storage space would be modified to accommodate the water tank 21, the water heater system 28, the high pressure pump 30, part of the snow conveyance means 9, and any associated connection means required in the operation of the invention.

Figure 3:
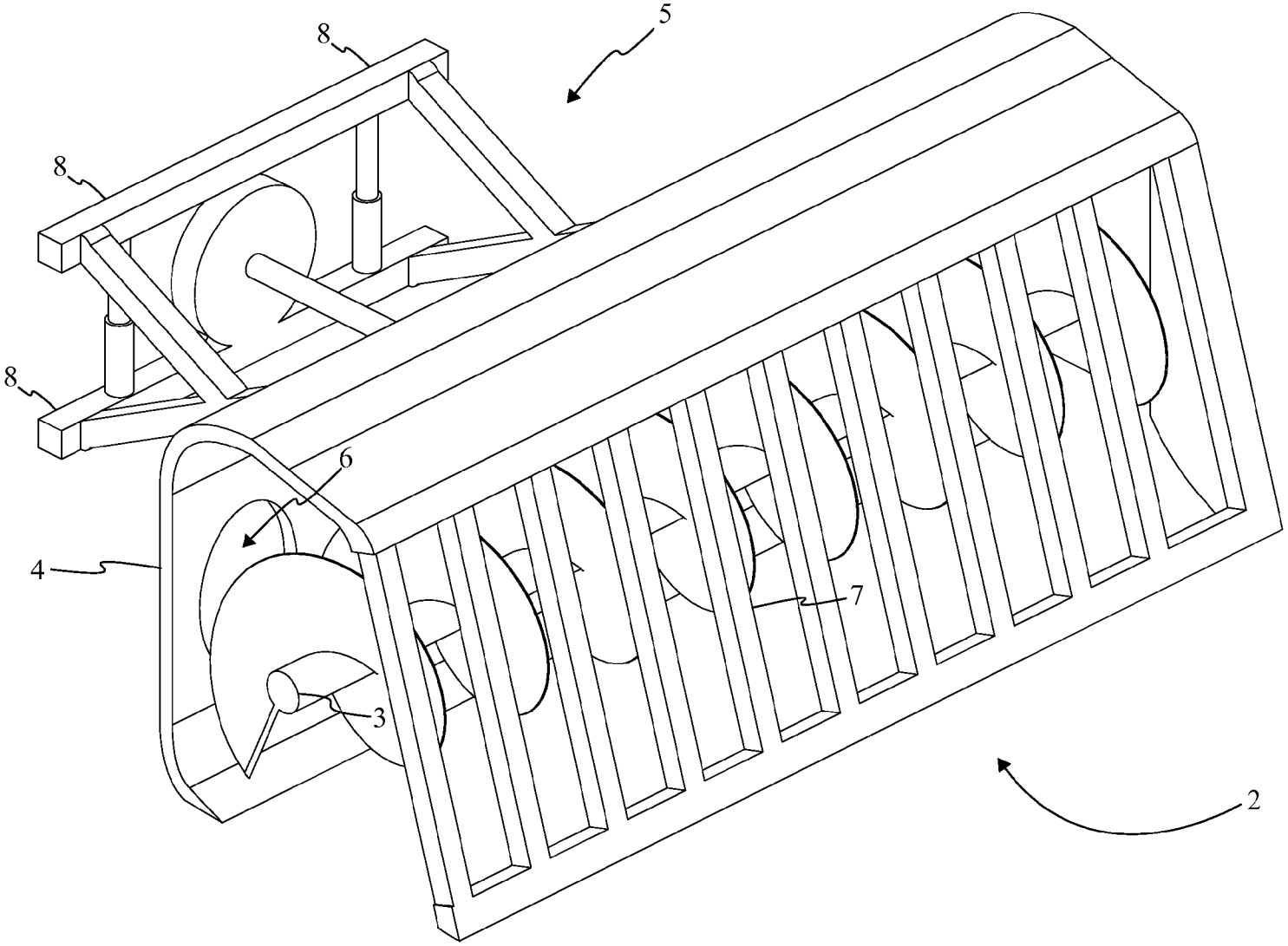
FIG. 3 is a frontal perspective view displaying the general component arrangement of the snow collection means as per the current embodiment of the present invention.
Figure 4:
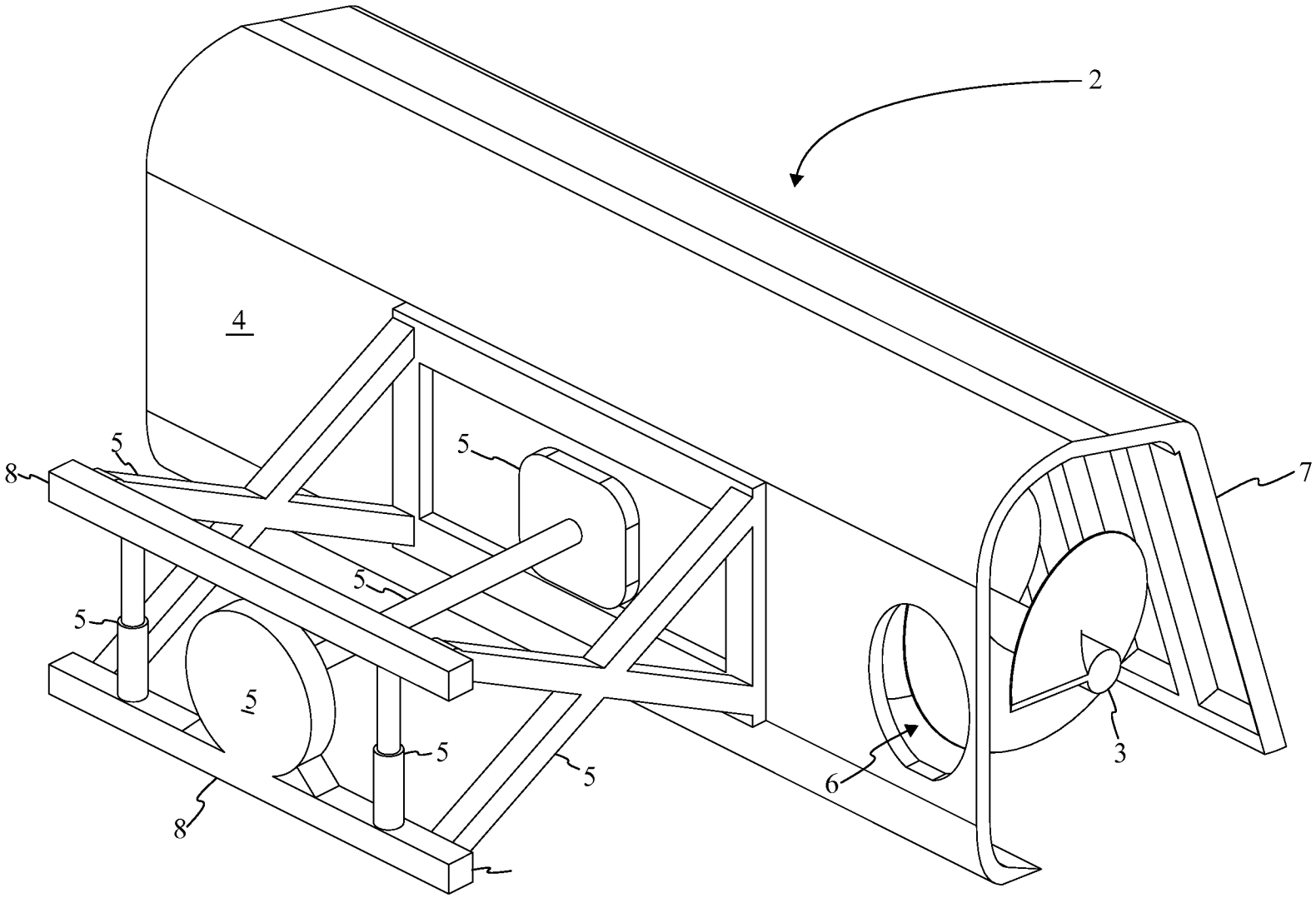
FIG. 4 is a rear perspective view displaying the general component arrangement of the snow collection means as per the current embodiment of the present invention.

Referencing FIG. 3 and FIG. 4, the snow collection means 2 is a mechanical system that collects snow from the environment. The snow collection means 2 is provided with a coincident positioning with the snow conveyances means. The coincident positioning between the snow collection means 2 and the snow conveyances means enables the operation of the present invention by allowing the snow collection means 2 to direct the collected snow to the snow conveyances means enabling it to be melted and stored within the water tank 21. In the current embodiment of the present invention, the snow collection means 2 comprises a collection housing 4, a separator 7, a collection auger 3, an exit opening 6, a hydraulic system 5, and a vehicles mount. The collection housing 4 is a structure that partially encloses the collection auger 3 facilitating the collection of snow. The separator 7 is a means of preventing large debris from coming into contact with the collection auger 3. The collection auger 3 is a rotating bladed shaft that directing snow towards the exit opening 6. The exit opening 6 is the space through which the collection auger 3 expels the collect snow through. The hydraulic system 5 is the actuating feature of the snow collection means 2 that drives the collection auger 3 and the extended positioning of the collection housing 4 relative to the vehicle mount 8. The vehicle mount 8 is the structure that secures the snow collection means 2 to the existing vehicle platform.

Referencing FIG. 3 and FIG. 4, the collection housing 4 is the structure that partially encloses the collection auger 3 and facilitates the collection of snow through its particular form. The collection housing 4 is a curved shield with particular contours that partially surround the collection auger 3. The collection housing 4 aligns the particular contours to with the collection auger 3 to direct the collected snow towards the exit opening 6. The collection auger 3 is rotatably positioned within an enclosed space formed by the collection housing 4 and the separator 7.

Referencing FIG. 3 and FIG. 4, the collection housing 4 is positioned between the vehicle mount 8 and the separator 7. The collection housing 4 is extendably positioned with the vehicle mount 8. The extendable positioning is provided through the hydraulic system 5 which enables the distance between the collection housing 4 and the vehicle mount 8 to increase or decrease in order to accommodate the operation of the present invention in different environments.

Referencing FIG. 3, the separator 7 is a selective barrier that allows snow to pass through but prevents large debris from contacting the collection auger 3. The separator 7 is positioned opposite the collection housing 4 relative to collection auger 3. The separator 7 is able to withstand heavy forces for large pieces of debris while permitting snow to pass through to the collection auger 3. The separator 7 can be accomplished by a plurality of means that include but are not limited to screens and grates with large enough opening that do not restrict the passage of snow to the collection auger 3.

Referencing FIG. 3 and FIG. 4, the collection auger 3 is the rotating bladed shaft driven by the hydraulic system 5 that directs collected snow through the exit opening 6. The collection auger 3 is rotatably positioned between the collection housing 4 and the separator 7. The collection auger 3 utilizes blades that are sized and separated to optimally remove snow at the rotational speed of the collection auger 3. The positioning of the collection auger 3 to the collection housing 4 facilitates the movement of collected snow towards the exit opening 6. The exit opening 6 is operatively aligned with the collection auger 3. The exit opening 6 is a formed opening that traverses into the enclosed spaced between the collection housing 4 and the separator 7 holding the collection auger 3.

Figure 6:
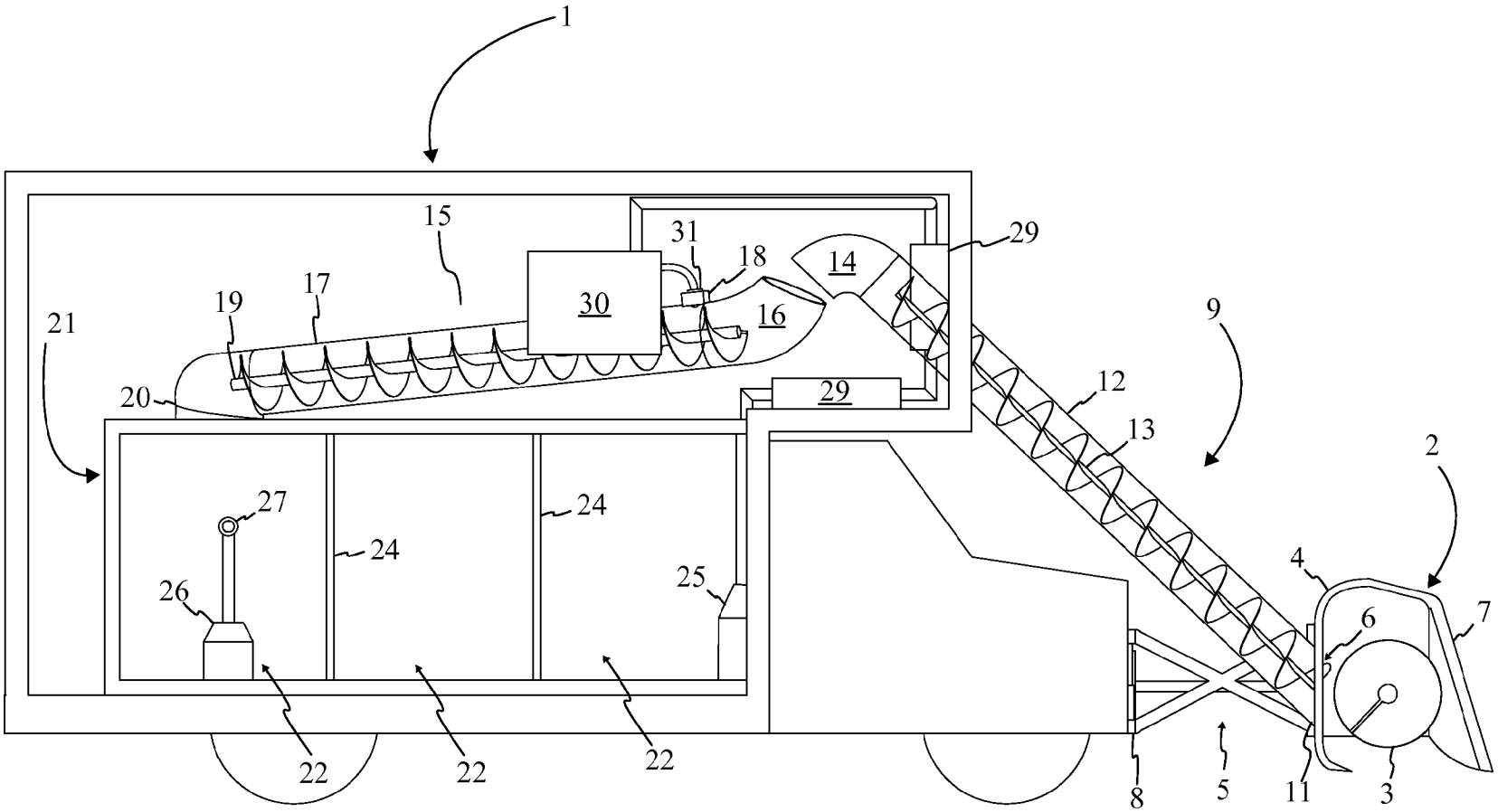
FIG. 6 is another sectional view displaying the component distribution within the insulated enclosure and water tank as per the current embodiment of the present invention.
Figure 7:
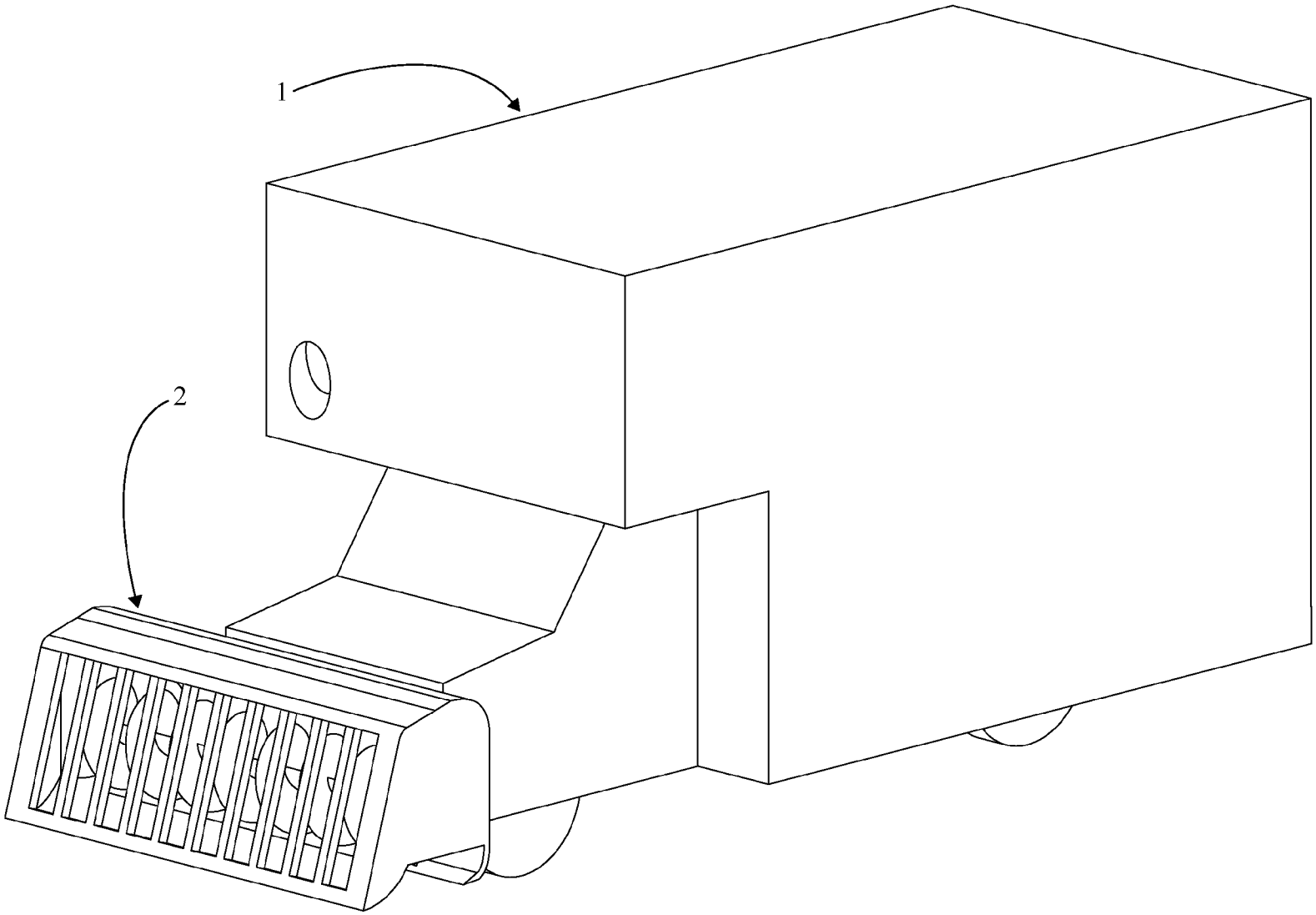
FIG. 7 is a frontal perspective view displaying the first auger assembly removed for facilitated storage and transportation as per the current embodiment of the present invention.

Referencing FIG. 3, FIG. 4, and FIG. 6, the exit opening 6 is the space through which collected snow is directed through by the collection auger 3. The exit opening 6 traverses the enclosed space formed by the collection housing 4 and the separator 7. The positioning of the exit opening 6 is operatively aligned with the collection auger 3 and the rotation of the collection auger 3 directs the collected snow through the exit opening 6. The exit opening 6 becomes operatively coincident with the snow conveyance means 9 allowing the collected snow to be transported to the water tank 21 within the insulated enclosure 1. The exit opening 6 contains particular features that enable a detachable coupling with a collection opening 11 of the snow conveyance means 9. The detachable coupling between the exit opening 6 and the collection opening 11 permits the portions of the snow conveyance means 9 to be removed and stored when the present invention is not being use.

Referencing FIGS. 3-4 and FIGS. 6-7, the hydraulic system 5 is the actuating means that drives the collection auger 3 and the extendable movement of the collection housing 4. The hydraulic system 5 is powered by the existing vehicle's motor which can be either through its drive train or an electrical unit. The hydraulic system 5 utilizes a force transfer mechanism to enable the vehicles motor to drive the operations of hydraulic units responsible for the rotational movement of the collection auger 3 and the directional movement of the collection housing 4. The hydraulic system 5 is positioned adjacent to the vehicle mount 8. The adjacent positioning of the hydraulic system 5 to the vehicle mount 8 facilitates mechanical engagements with the existing vehicles motor by way of the force transfer mechanism.

Referencing FIG. 3 and FIG. 4, the vehicle mount 8 is a structure of the snow collection means 2 that securely engages the snow collection means 2 to the existing vehicle platform. The vehicle mount 8 is positioned adjacent to the hydraulic system 5. The adjacent positioning of the vehicle mount 8 with the hydraulic system 5 is incidental due to the vehicle mount 8 being engaged to the existing vehicle platform and the hydraulic system 5 being engaged to the existing vehicles motor. The vehicle mount 8 is extendably positioned to the collection housing 4 as the hydraulic system 5 enables a directional movement of the collection housing 4 relative to the vehicle mount 8.

Referencing FIGS. 1-2 and FIGS. 5-6, the snow conveyance means 9 transports snow collected from the snow collection means 2 and deposits it in the water tank 21. The snow conveyance means 9 is operatively coincident with the snow collection means 2. The coincident positioning, allows collected snow to be directed into the snow conveyance means 9. The snow conveyance means 9 traverse into the insulated enclosure 1 in order to interface with the water tank 21. The snow conveyance means 9 is in fluid communication with the high pressure nozzle 31. The high pressure nozzle 31 is discharges a stream of heated water into the portion of the snow conveyance means 9 within in the insulated enclosure 1 in order to melt the collected snow with before it reaches the water tank 21. The snow conveyance means 9 interfaces the water tank 21 as a means to deposit the melted snow. In the current embodiment of the present invention the snow conveyance means 9 comprises a first auger assembly 10 and a second auger assembly 15. The first auger assembly 10 is operatively aligned with the snow collection means 2 by way of the exit opening 6. The first auger assembly 10 transports collected snow from the snow collection means 2 towards the second auger assembly 15. The second auger assembly 15 is positioned within the insulated enclosure 1 and interfaces the water tank 21. The first auger assembly 10 is operatively coincident with the second auger assembly 15 permitting the collected snow transported by the first auger assembly 10 to be transferred to the second auger assembly 15. In order to align with the second auger assembly 15 the first auger assembly 10 traverses the insulated enclosure 1. The positioning of the second auger assembly 15 facilitates the engagement with the high pressure nozzle 31.

Referencing FIGS. 1-2 and FIGS. 5-6, the first auger assembly 10 comprises a collection opening 11, a first pipe 12, a first auger 13, and a transfer opening. The first auger 13 is rotatably positioned within the first pipe 12 allowing for the transportation of collected snow through the first auger assembly 10. The collection opening 11 and the first transfer opening 14 are oppositely positioned across the first pipe 12. The collection opening 11 aligns with the exit opening 6. The first transfer opening 14 operatively aligns with the second auger assembly 15.

Figure 5:
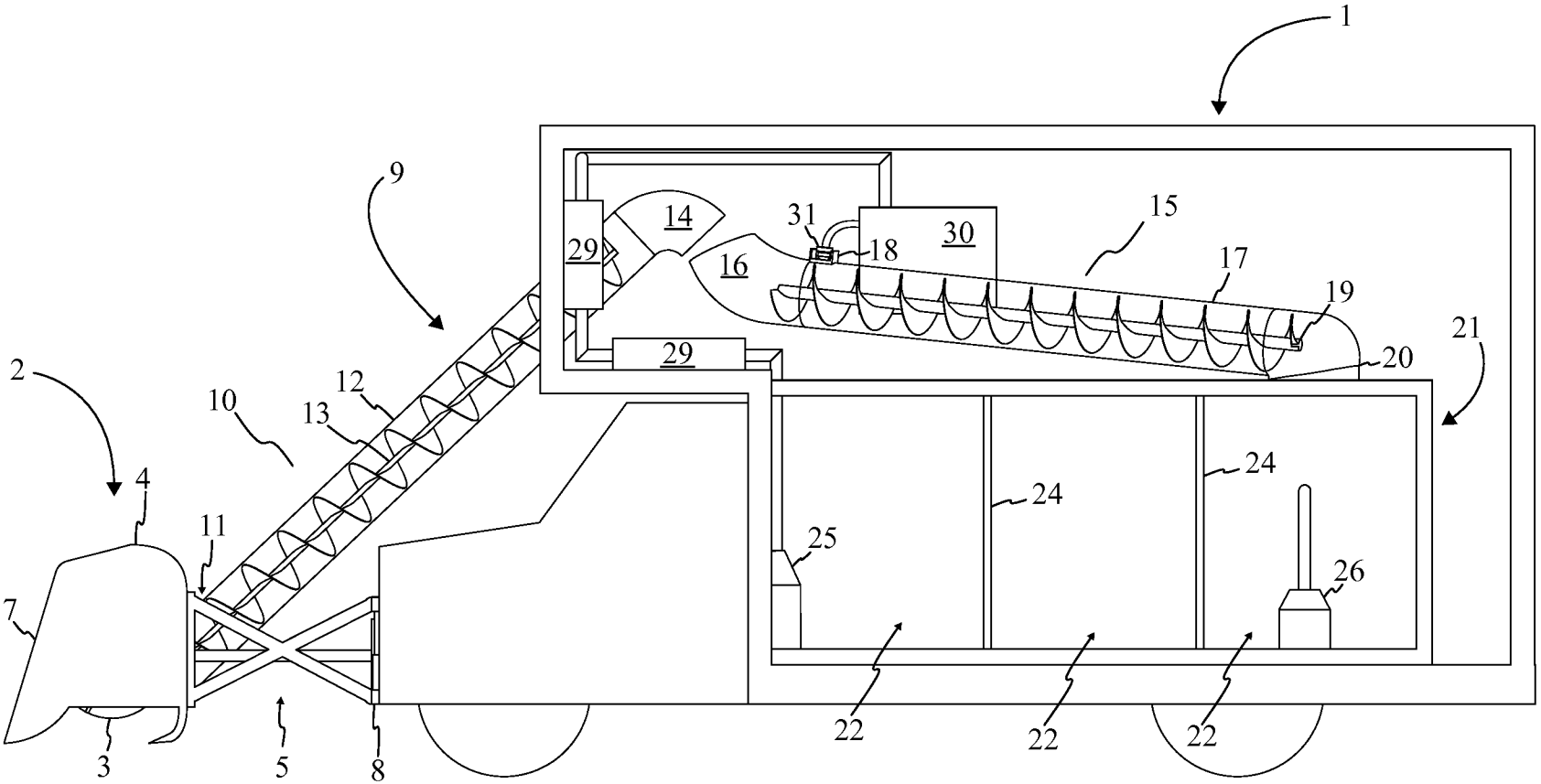
FIG. 5 is a sectional view displaying the component distribution within the insulated enclosure and the water tank as per the current embodiment of the present invention.

Referencing FIG. 5 and FIG. 6, the first auger 13 is positioned within the first pipe 12. The first pipe 12 spans the length of the first auger 13. The first auger 13 rotates within the first pipe 12 in order to transport the collected snow towards the second auger assembly 15. The rotation of the first auger 13 directs the collected snow from the collection opening 11 towards the first transfer opening 14. The first auger 13 utilizes blades that are sized and separated to optimally transport snow at a rate comparable to the rate at which snow is received from the snow collection means 2. The first auger 13 is provided with the first pipe 12 that limits gaps between the blades of the first auger 13 and the interior walls of the first pipe 12 improving conveyances of the collected snow.

Referencing FIG. 6, the collection opening 11 operatively aligns with the exit opening 6 of the snow collection means 2. The operative alignment allows for the collected snow directed through the exit opening 6 to be transported by the first auger 13 along the length of the first pipe 12 by way of the rotational motion of the first auger 13. The collection opening 11 is removably positioned with the exit opening 6. The removable positioning provides the interface between the collection opening 11 and the exit opening 6 as being a non permanent alignment permitting the first auger assembly 10 to removed and stored when the present invention is not in use or in traffic. The collection opening 11 is positioned at the opposite end of the first pipe 12 relative to the positioning of the first transfer opening 14.

Referencing FIG. 5 and FIG. 6, the first transfer opening 14 is the portion of the first auger assembly 10 that aligns with the second auger assembly 15. The collected snow transported along the length of the first pipe 12 is directed out of the first pipe 12 through the first transfer opening 14. The first transfer opening 14 is provided with an operative alignment with the second auger assembly 15. The operative alignment can be accomplished by positioning the first transfer opening 14, and subsequently a portion of the first auger assembly 10 within the insulated enclosure 1.

Referencing FIGS. 1-2 and FIGS. 5-6, the second auger assembly 15 comprises a second transfer opening 16, a second pipe 17, a recessed nozzle mount 18, a second auger 19, and an ejection port 20. The second auger 19 is rotatably positioned within the second auger 19 pipe. The second transfer opening 16 is positioned opposite ejection port 20 across the length of the second auger 19 pipe. The recessed nozzle mount 18 is positioned adjacent to the second transfer opening 16 and provides a non obstructing engagement point for the high pressure nozzle 31. The ejection port 20 interfaces the water tank 21 in order to deposit the melted snow.

Referencing FIG. 5 and FIG. 6, the second auger 19 is rotatably positioned within the second pipe 17. The second pipe 17 spans the length of the second auger 19. The second auger 19 and the second pipe 17 are particularly suited to transport snow and water as the high pressure nozzle 31 melts the snow received from the first auger assembly 10. The rotation of the second auger 19 directs the snow and melted snow from the second transfer opening 16 towards the ejection port 20. The second auger 19 incorporates blade that are sized and separated to optimally transport snow and water at a rate comparable to the rate at which snow is received from the first auger assembly 10 and the rate at which water is received from the high pressure nozzle 31. The second auger 19 and the second pipe 17 can be structured different from the first auger 13 and first pipe 12 due to the difference in their cargo.

Referencing FIG. 5 and FIG. 6, the recessed nozzle mount 18 is provided as the particular engagement for the high pressure nozzle 31. The recessed nozzle mount 18 is provided with a positioning that aligns the high pressure stream of water from the high pressure nozzle 31 with the collected snow within the second pipe 17 being transported by the second auger 19. The recessed nozzle mount 18 provides an operative alignment for the high pressure nozzle 31 that reduces the likelihood of unwanted interference between the high pressure nozzle 31 and the rotation of the second auger 19. The recessed nozzle mount 18 is positioned adjacent to the second transfer opening 16. The positioning of the recessed nozzle mount 18 provides a longer interaction time between heated water expelled from the high pressure nozzle 31 and the collected snow as the interaction occurs across the length of the second pipe 17.

Referencing FIG. 5 and FIG. 6, the second transfer opening 16 is operatively aligned with the first transfer opening 14. The second transfer opening 16 receives collected snow from the first transfer opening 14. The second transfer opening 16 is positioned opposite the ejection port 20 across the length of the second pipe 17. The second transfer opening 16 is allows the collected snow received from the first transfer opening 14 to be transported by the second auger 19. The second transfer opening 16 does not require a direct engagement or alignment with the first transfer opening 14. The operative alignment between the first transfer opening 14 and the second transfer opening 16 can be facilitated by including features that funnel the collected snow through the second transfer opening 16.

Referencing FIGS. 1-2 and FIGS. 5-6, the ejection port 20 interfaces the water tank 21 in order to deposit the melted snow and heated water within the water tank 21. The ejection port 20 is operatively coincident with an interior chamber 22 of the water tank 21. The ejection port 20 is provided with means to deposit the combined volume of the heated water and melted snow into the interior chamber 22 of the water tank 21.

Referencing FIG. 2, FIG. 5, and FIG. 6, the water tank 21 is the container that receives the melted snow from the snow conveyance means 9 and the heated water from the high pressure nozzle 31. The water tank 21 is in fluid communication with the water heater system 28 allowing water from the water tank 21 to be heated for use by the high pressure pump 30. In the current embodiment of the present invention, the water tank 21 comprises an interior chamber 22, a filtration means 23, a first water pump 25, a second water pump 26, and a drainage spout 27. The interior chamber 22 collects heated water and melted snow from the second auger assembly 15. The filtration means 23 is positioned within the interior chamber 22 in order to separate the small debris from the melted snow that could potentially damage components in fluid communication with either the first water pump 25 or the second water pump 26. The first water pump 25 drives water from the interior chamber 22 towards the water heater system 28. The second water pump 26 drives water from the interior chamber 22 towards the drainage spout 27. The drainage spout 27 is provided as a means of getting rid of the water from the water tank 21.

Referencing FIG. 2, FIG. 5, and FIG. 6, the interior chamber 22 is coincident with the ejection port 20 of the second auger assembly 15. The interior chamber 22 is the interior space of the water tank 21 that holds the filtration means 23, the first water pump 25, and the second water pump 26. The interior chamber 22 of the water tank 21 is partitioned by the filtration means 23. The positioning of the filtration means 23 prevents small debris from the melted snow to damage associated components in fluid communication with the first water pump 25 or the second water pump 26. In the current embodiment of the present invention, the filtration means 23 comprises at least two filter screens 24. The first filter screen 24 captures larger particles while the smaller screen catches particles that avoided capture by the first filter screen 24. The first filter screen 24 is positioned adjacent to the interface point between the ejection port 20 and the interior chamber 22. The second filter screen 24 is positioned near the first water pump 25. the positioning of the at least two filter screen 24 subdivides the interior chamber 22 into at least three compartments where the first compartment is the coincident with the ejection port 20, and separated by the first filter screen 24. The second compartment is separated by the first filter screen 24 and the second filter screen 24. The third compartment contains the first water pump 25 and is separated by the second filter screen 24. Due to the second water pump 26 being used to remove excess water, the second water pump 26 could be positioned within any of the chambers if desired.

Referencing FIG. 2, FIG. 5, and FIG. 6, the first water pump 25 is provided as a means of driving water from the interior chamber 22 towards the water heater system 28. The first water pump 25 is positioned opposite the ejection port 20 across the filtration means 23. The positioning of the first water pump 25 reduces potential debris from being drive up towards the water heater system 28, the high pressure pump 30, and the high pressure nozzle 31. The first water pump 25 is provided with a flow rate that is sufficient to supply a consistent volume of water in order to adequately meet the needs of the water heater system 28, the high pressure pump 30, and the high pressure nozzle 31. The high pressure nozzle 31 is rated to expel a high volume of water that requires the first water pump 25 to have a comparable flow rate to ensure that a consistent flow rate is maintained.

Referencing FIG. 6, the second water pump 26 is provided as a means of getting rid of water from the water tank 21. The second water pump 26 is in fluid communication with the drainage spout 27. The drainage spout 27 traverses the insulted enclosure. The drainage spout 27 permits attachment to a secondary water tank 21 as a means of removing excess water. The drainage spout 27 used to eject water from the water tank 21 into a drainage sewer. The second water pump 26 may be positioned throughout the interior chamber 22 regardless of the positioning of the filtration means 23 as the secondary water pump could be used to remove debris and excess water from the water tank 21. The second water pump 26 removes excess water from the water tank 21 but leaves sufficient volume to be used by the water heater system 28.

Referencing FIG. 2, FIG. 5, and FIG. 6, the water heater system 28 is the means by which water is heated to a particular temperature in order to melt the collected snow. The water heater system 28 is positioned within the insulated enclosure 1. The positioning of the water heater system 28 within the insulated enclosure 1 reduces the energy cost to heat water from the water tank 21 by reducing heat loss to environment. The water heater system 28 is supplied with water from water tank 21 by way of the first water pump 25. The water heater system 28 heats water that is the pressurized by the high pressure pump 30 prior to being expelled into the second auger assembly 15 by way of the high pressure nozzle 31. In the current embodiment of the present invention, the water heater system 28 comprises at least two water heaters 29 arranged in series. the at least two water heaters 29 are provided in a manner that enables incremental temperatures increases as water is transferred from a water hear with a lower temperature to a water heater 29 with a higher temperature. For instance a first water heater 29 would heat water from 40° F. to 60° F. while the second water heater 29 would heat the water from the first water heater 29 from 60° F. to 80° F. Through the arrangement of the at least two water heaters 29, the water heater system 28 would maintain a more consistent temperature when the water is expelled through the high pressure nozzle 31. In the current embodiment of the present invention, the water heater system 28 can consistently provide the high pressure pump 30 with water heated to temperatures above 100° F. It should be noted that the heater system can be implemented as a tankless water heater system 28.

Referencing FIG. 2, FIG. 5, and FIG. 6, the high pressure pump 30 pressurizes the heated water from the water heater system 28 for use by the high pressure nozzle 31. The high pressure pump 30 is in fluid communication with the water heater system 28 and the high pressure nozzle 31. The high pressure pump 30 pressurizes the heated water to a pressure of at least 1000 pounds per square inch (PSI). Once the heated water is pressurized by the high pressure pump 30, the high pressure pump 30 expels the heated and pressurized water through the high pressure nozzle 31.

Referencing FIG. 2, FIG. 5, and FIG. 6, the high pressure nozzle 31 ejects a stream of heated and pressurized water into the second auger assembly 15 in order to melt collected snow being transported to the water tank 21. The high pressure nozzle 31 is mounted in the recessed nozzle mount 18 of the second auger assembly 15. The recessed nozzle mount 18 is found positioned adjacent to the second transfer opening 16. In the current embodiment of the present invention, the high pressure nozzle 31 expels a sufficiently high volume of heated water to melt the collected snow. It should be noted that alternative configurations may modify the expelled volume in order to adjust to the scale of the present invention. Furthermore, it should be noted that the high pressure nozzle 31 may be configured as a plurality of high pressure nozzles 31 positioned in a plurality of recessed nozzle mounts 18.

The snow removal vehicle can comprises a snow collection means 2 to collect snow, a snow conveyance means 9 to transfer the collected snow, a water tank 21, at least one water heater 29, at least on high pressure pump 30, at least one high pressure nozzle 31, and a water pump placed inside the water tank 21. The snow collection means 2 will collect snow from the environment such as road, parking lot, or other surfaces that can be reached by the vehicle. The snow collection means 2 can be installed in the front end of the snow removal vehicle, so the snow in the vehicle's path will be collected as the vehicle moves forward. The snow collection means 2 can also be installed in other desirable sections of the vehicle.

Once the snow is collected from the environment by the snow collection means 2, a snow conveyance means 9 will transfer the snow from the snow collection means 2 to a water tank 21 located inside the vehicle. The size of the water tank 21 may vary depending on the side of the vehicle. The water tank 21 can be removable or permanently installed.

A water pump may be installed inside the water tank 21 will pump the water stored in the water tank 21 to a water heater system 28. The water heater system 28 can be a tankless water heater 29 or a conventional water heater 29. The water heater system 28 will heat the water to a desirable temperature. A high pressure pump 30 will then pump the hot water from the water heater system 28 into a high pressure nozzle 31, high pressure nozzle 31 will release the hot water directly into the snow conveyance means 9. The hot water from the high pressure nozzle 31 will melt the collected snow into water, and the melted snow along with the hot water will be transferred into the water tank 21.

In one embodiment, the said snow conveyance means 9 can comprise a first pipe 12, an first auger 13, a second pipe 17, and a second auger 19. The first auger 13 is installed inside the first pipe 12, the first pipe 12 is vertically aligned at a 45° degree angle upward from the snow collection means 2. The second auger 19 is placed inside the second pipe 17, and the second pipe 17 is aligned at a 90° degree angle with the first pipe 12.

The upward auger transfers snow from the snow collection means 2 upward through the first pipe 12. There can be an opening at the upper end of the first pipe 12 and the snow is dropped into the second pipe 17 through the opening. The snow then is transferred downward into the water tank 21 by the second auger 19.

In one embodiment, the high pressure nozzle 31 is placed just above a hole or opening on the upper end of the second pipe 17. The high pressure nozzle 31 will spray hot water into the second pipe 17 through the hole or opening. The high pressure pump 30 will cause the hot water to be released from the high pressure nozzle 31 at a very high velocity.

In one embodiment, the water heater 29 can be a tankless water heater 29. Due to the enclosed environment of the vehicle, a generator or an alternator may be needed to power the water heaters 29, any water pumps installed in the vehicle, and any other auxiliary motors. Using propane to heat he water heater 29 is also possible.

In one embodiment, excessive water can be released back into the environment when ambient temperature is above 35 F or dumped into the drainage system from the water tank 21 through a release device.

In an embodiment of the invention the snow removal vehicle can comprise at least two water heaters 29, a first water pump 25 placed inside the water tank 21, a second water pump 26 placed inside the water tank 21, and at least one water filter screen 24.

In this embodiment, the first water pump 25 pumps the water in the water tank 21 to at least one water heater system 28. The second water pump 26 pumps the water from the water tank 21 to an additional storage tank. The second water is placed at a higher elevation than the first water pump 25, and the second water pump 26 will be turned on only when the water level inside the water tank 21 reaches it. This arrangement allows the second water pump 26 to be turned off when water level in the water tank 21 is relatively low thus a certain amount of water will always be left inside the water tank 21 to feed the water heater system 28.

In this embodiment, water tank 21 can further comprise at least one filtration means 23. When the water passes through the filtration means 23, various debris are collected by the filtration means 23 to keep the water clean. Clean water can help protect the water pumps and the water heater system 28 to allow the mechanism longer service life.

In this embodiment, the filtrations means can comprise at least two filtration screens with decreasing mesh size. Larger debris can be trapped by the filtration screens with larger mesh size and smaller debris can be trapped by the filtration screens with smaller mesh size. This arrangement allows the filtration means 23 to work more efficiently by distributing the debris to more than one filtration screens. The first water pump 25 can be placed behind the filtration screen with the smallest mesh size water which goes to the water heater system 28 and high pressure nozzle 31 must be the cleanest because the mechanisms can be very sensitive.

In this embodiment, there can be at least two water heaters 29 connected in series. The first water heater 29 in the series heats the water to a predetermined temperature, and each of the next water heaters 29 in the series heats the water to a higher temperature than the water in the previous water heater 29. For example, the first water heater 29 in the series heats the water from 40° F. to 90° F., and the second water heater 29 in the series heats the water from 90° F. to 120° F. The arrangement allows the water heater system 28 to work more efficiently, and water can be heated to a higher temperature.

In an embodiment of the invention, the snow removal vehicle can further comprise at least one secondary water tank 21 to receive water from the second water pump 26. Due to the limited size of the water tank 21, additional storage may be needed to hold the excessive water. A secondary water tank 21 can be attached to the snow removal vehicle. A water pipe will be running from the secondary water tank 21 to the second water pump 26. When the water level inside the water tank 21 reaches the second water pump 26, the second water pump 26 will pump the water into the secondary water tank 21 through the water pipe. The secondary water tank 21 will act as additional storage for water that cannot be held inside the water tank 21 and cannot be release into the environment.

In one embodiment, excessive water can also be released back into the environment when ambient temperature is above 35° F. or dumped into the drainage system through a drainage spout 27 on the storage tank.

In another embodiment, an additional ice melting chemical distribution system or device can be attached to the secondary water tank 21. The ice melting chemical distribution system or device distribute chemicals such as salt, calcium chloride, magnesium chloride solution or other ice melting chemicals. The ice melting chemical distribution system or device can dispense the said chemical into the environment to prevent ice from freezing on roadways, parking lots or other surfaces.

The method of implementing the snow removal vehicle best demonstrated by describing the path of the snow as it interacts with the snow removal vehicle. The snow will be first collected by the snow collection means 2 from the environment. A snow conveyance means 9 will transfer the snow from the snow collection means 2 to a water tank 21. While the snow is still in the snow conveyance means 9, hot water from the water heater system 28 is applied to the snow. Once the snow reaches the water tank 21, it should have been melted into water. The water created by the melted snow is recycled back into the water heater system 28 to create more hot water. When the amount of water in the water tank 21 reaches a certain capacity, the water will be pumped into a secondary water tank 21 for temporary storage.

In an embodiment of the invention, the snow collection means 2 can comprise a collection auger 3, a hydraulic system 5, at least one hydraulic unit, at least one motor, a force transfer mechanism, a separator 7, and an exit opening 6.

The collection auger 3 collects snow from the environment such as the road or the parking lot. In order to place the collection auger 3 at the most optimal positions to collect snow from the environment, the motor will work in conjunction with the hydraulics and force transfer mechanism can move the collecting means in vertical, horizontal and longitudinal directions. The distance between the collection housing 4 and the vehicle mount 8 can be reduced to save space.

In this embodiment, there is also a hydraulic system 5 that can be expanded to different width and used as a wedge to push snow into the collection auger 3. The hydraulic system 5 can be adjusted according to the width of the road to fit a particular snow removal mission. There can also be a separator 7 to keep large object from entering the auger. Often, there could be large animal carcass or rocks on the road. If those objects can damage the snow collection means 2 by entering into the collection auger 3. Therefore, a separator 7 comprising vertical metal slates or wire screen is needed to keep the objects out.

Although the invention has been explained in relation to its preferred embodiment, it is to be understood that many other possible modifications and variations can be made without departing from the spirit and scope of the invention as hereinafter claimed.

What is claimed is:

1. A snow removal vehicle comprises:

a insulated enclosure;

a snow collection means;

a snow conveyance means;

a water tank;

a water heater system;

a high pressure nozzle;

a high pressure pump;

the snow collection means comprises a collection auger, a collection housing, a hydraulic system, an exit opening, a separator, and a vehicle mount;

the snow conveyance means comprises a first auger assembly and a second auger assembly;

the water tank comprises an interior chamber, a filtration means, a first water pump, a second water pump, and a drainage spout;

the first auger assembly comprises a collection opening, a first pipe, a first auger, and a first transfer opening;

the second auger assembly comprises a second transfer opening, a second pipe, a recessed nozzle mount, a second auger, and an ejection port;

the water tank and the water heater system being positioned within the insulated enclosure;

the water tank being in fluid communication with the water heater system;

the high pressure nozzle being in fluid communication with the water heater system by way of the high pressure pump;

the high pressure nozzle being in fluid communication with the snow conveyance means;

the insulated enclosure being traversed by the snow conveyance system;

the water tank being interfaced by the snow conveyance system; and the snow conveyance means being operatively coincident with the snow collection means;

the interior chamber being partitioned by the filtration means;

the first water pump and the second water pump being positioned within the interior chamber;

the first water pump being positioned opposite to the ejection port across the filtration means:

the first water pump being in fluid communication with the water heater system;

the drainage spout traverses the insulated enclosure; and the second water pump being in fluid communication with the drainage spout.

2. The snow removal vehicle as claimed in claim 1, wherein the water heater system comprises at least two water heaters arranged in series.

3. The snow removal vehicle as claimed in claim 1 comprises:

the collection auger being rotatably positioned between the collection housing and the separator;

the exit opening being operatively aligned with the collection auger;

the vehicle mount being positioned opposite the separator across the collection housing;

the vehicle mount being positioned adjacent to the hydraulic system; and the hydraulic system being operatively coupled to the collection auger.

4. The snow removal vehicle as claimed in claim 3, wherein the collection housing being extendably positioned to the vehicle mount by way of the hydraulic system.

5. The snow removal vehicle as claimed in claim 1 comprises:

the first auger assembly traverses into the insulated enclosure;

the second auger assembly being positioned within the insulated enclosure;

the first auger assembly being operatively coincident with the second auger assembly; and the water tank being coincident with the second auger assembly opposite the first auger assembly.

6. The snow removal vehicle as claimed in claim 1 comprises:

the first auger being rotatably positioned within the first pipe;

the collection opening being positioned opposite the first transfer opening across the first pipe;

the collection opening being coincident with the exit opening;

the first transfer opening being operatively aligned with the second transfer opening;

the second auger being rotatably positioned within the second pipe;

the second transfer opening being positioned opposite the ejection port across the second pipe;

the high pressure nozzle being engaged to the recessed nozzle mount adjacent to the second transfer opening; and the ejection port being operatively coincident with the interior chamber of the water tank.

7. The snow removal vehicle as claimed in claim 1 comprises:

the snow conveyance means being detachably coupled with the snow collection means; and the exit opening of the snow collection means being detachably coupled to the collection opening of the first auger assembly.

8. The snow removal vehicle as claimed in claim 1, wherein the interior chamber being partitioned by at least two filter screens.

9. A snow removal vehicle comprises:

a insulated enclosure;

a snow collection means;

a snow conveyance means;

a water tank;

a water heater system;

a high pressure nozzle;

a high pressure pump;

the snow collection means comprises a collection auger, a collection housing, a hydraulic system, an exit opening, a separator, and a vehicle mount;

the snow conveyance means comprises a first auger assembly and a second auger assembly;

the water tank comprises an interior chamber, a filtration means, a first water pump, a second water pump, and a drainage spout;

the water heater system comprises at least two water heaters arranged in series;

the first auger assembly comprises a collection opening, a first pipe, a first auger, and a first transfer opening;

the second auger assembly comprises a second transfer opening, a second pipe, a recessed nozzle mount, a second auger, and an ejection port;

the water tank and the water heater system being positioned within the insulated enclosure;

the water tank being in fluid communication with the water heater system;

the interior chamber being partitioned by the filtration means;

the first water pump and the second water pump being positioned within the interior chamber;

the first water pump being positioned opposite to the ejection port across the filtration means;

the first water pump being in fluid communication with the water heater system;

the drainage spout traverses the insulated enclosure;

the second water pump being in fluid communication with the drainage spout;

the high pressure nozzle being in fluid communication with the water heater system by way of the high pressure pump;

the high pressure nozzle being in fluid communication with the snow conveyance means;

the insulated enclosure being traversed by the snow conveyance system;

the water tank being interfaced by the snow conveyance system;

the snow conveyance means being operatively coincident with the snow collection means;

the collection auger being rotatably positioned between the collection housing and the separator;

the exit opening being operatively aligned with the collection auger;

the vehicle mount being positioned opposite the separator across the collection housing;

the vehicle mount being positioned adjacent to the hydraulic system;

the hydraulic system being operatively coupled to the collection auger;

the first auger assembly traverses into the insulated enclosure;

the second auger assembly being positioned within the insulated enclosure;

the first auger assembly being operatively coincident with the second auger assembly;

the water tank being coincident with the second auger assembly opposite the first auger assembly;

the first auger being rotatably positioned within the first pipe;

the collection opening being positioned opposite the first transfer opening across the first pipe;

the collection opening being coincident with the exit opening;

the first transfer opening being operatively aligned with the second transfer opening;

the second auger being rotatably positioned within the second pipe;

the second transfer opening being positioned opposite the ejection port across the second pipe;

the high pressure nozzle being engaged to the recessed nozzle mount adjacent to the second transfer opening; and the ejection port being operatively coincident with the interior chamber of the water tank.

10. The snow removal vehicle as claimed in claim 9, wherein the collection housing being extendably positioned to the vehicle mount by way of the hydraulic system.

11. The snow removal vehicle as claimed in claim 9 comprises:

the snow conveyance means being detachably coupled with the snow collection means; and the exit opening of the snow collection means being detachably coupled to the collection opening of the first auger assembly.

12. The snow removal vehicle as claimed in claim 9, wherein the interior chamber being partitioned by at least two filter screens.

13. A snow removal vehicle comprises:

a insulated enclosure;

a snow collection means;

a snow conveyance means;

a water tank;

a water heater system;

a high pressure nozzle;

a high pressure pump;

the snow collection means comprises a collection auger, a collection housing, a hydraulic system, an exit opening, a separator, and a vehicle mount;

the snow conveyance means comprises a first auger assembly and a second auger assembly;

the water tank comprises an interior chamber, a filtration means, a first water pump, a second water pump, and a drainage spout;

the water heater system comprises at least two water heaters arranged in series;

the first auger assembly comprises a collection opening, a first pipe, a first auger, and a first transfer opening;

the second auger assembly comprises a second transfer opening, a second pipe, a recessed nozzle mount, a second auger, and an ejection port;

the water tank and the water heater system being positioned within the insulated enclosure;

the water tank being in fluid communication with the water heater system;

the interior chamber being partitioned by the filtration means, wherein the interior chamber being partitioned by at least two filter screens;

the first water pump and the second water pump being positioned within the interior chamber;

the first water pump being positioned opposite to the ejection port across the filtration means;

the first water pump being in fluid communication with the water heater system;

the drainage spout traverses the insulated enclosure;

the second water pump being in fluid communication with the drainage spout;

the high pressure nozzle being in fluid communication with the water heater system by way of the high pressure pump;

the high pressure nozzle being in fluid communication with the snow conveyance means;

the insulated enclosure being traversed by the snow conveyance system;

the water tank being interfaced by the snow conveyance system;

the snow conveyance means being operatively coincident with the snow collection means;

the collection auger being rotatably positioned between the collection housing and the separator;

the exit opening being operatively aligned with the collection auger;

the vehicle mount being positioned opposite the separator across the collection housing;

the vehicle mount being positioned adjacent to the hydraulic system;

the hydraulic system being operatively coupled to the collection auger;

the collection housing being extendably positioned to the vehicle mount by way of the hydraulic system;

the first auger assembly traverses into the insulated enclosure;

the second auger assembly being positioned within the insulated enclosure;

the first auger assembly being operatively coincident with the second auger assembly;

the water tank being coincident with the second auger assembly opposite the first auger assembly;

the first auger being rotatably positioned within the first pipe;

the collection opening being positioned opposite the first transfer opening across the first pipe;

the collection opening being coincident with the exit opening;

the first transfer opening being operatively aligned with the second transfer opening;

the second auger being rotatably positioned within the second pipe;

the second transfer opening being positioned opposite the ejection port across the second pipe;

the high pressure nozzle being engaged to the recessed nozzle mount adjacent to the second transfer opening; and the ejection port being operatively coincident with the interior chamber of the water tank.

14. The snow removal vehicle as claimed in claim 13 comprises:

the snow conveyance means being detachably coupled with the snow collection means; and the exit opening of the snow collection means being detachably coupled to the collection opening of the first auger assembly.

* * * * *